United States Patent [19]

York

[11] Patent Number: 4,678,087

[45] Date of Patent: Jul. 7, 1987

[54] MODULAR SKI RACK

[76] Inventor: Randall A. York, 16791 Summer Cloud La., Huntington Beach, Calif. 92646

[21] Appl. No.: 704,770

[22] Filed: Feb. 21, 1985

[51] Int. Cl.[4] ..... A47F 7/00

[52] U.S. Cl. ..... 211/70.5; 211/87

[58] Field of Search ..... 211/60.1, 70.5, 70.6, 211/87, 88

[56] References Cited

U.S. PATENT DOCUMENTS

| | | | |
|---|---|---|---|
| 3,104,778 | 9/1963 | Leonard | 211/60.1 X |
| 3,905,481 | 9/1975 | Laterra | 211/70.5 |
| 4,062,453 | 12/1977 | Gorlach | 211/70.5 |
| 4,410,095 | 10/1983 | Dembicks | 211/70.6 |

FOREIGN PATENT DOCUMENTS

| | | | |
|---|---|---|---|
| 2706330 | 8/1978 | Fed. Rep. of Germany | 211/70.5 |

*Primary Examiner*—Robert W. Gibson, Jr.

*Attorney, Agent, or Firm*—Knobbe, Martens, Olson & Bear

[57] ABSTRACT

A modular ski rack, the modular units of which can be connected end to end to form an extended, linear rack which can be mounted on a vertical surface, or as a free standing polygonal structure. Each modular unit consists of two parallel, linear rows of spaced, staggered, and vertically oriented pockets into which the tail end of the skis are inserted and supported in an upright, vertical position, the staggered arrangement of the pockets permitting close packing of the skis without entanglement with the skis in the adjacent pockets.

19 Claims, 10 Drawing Figures

Fig. 1
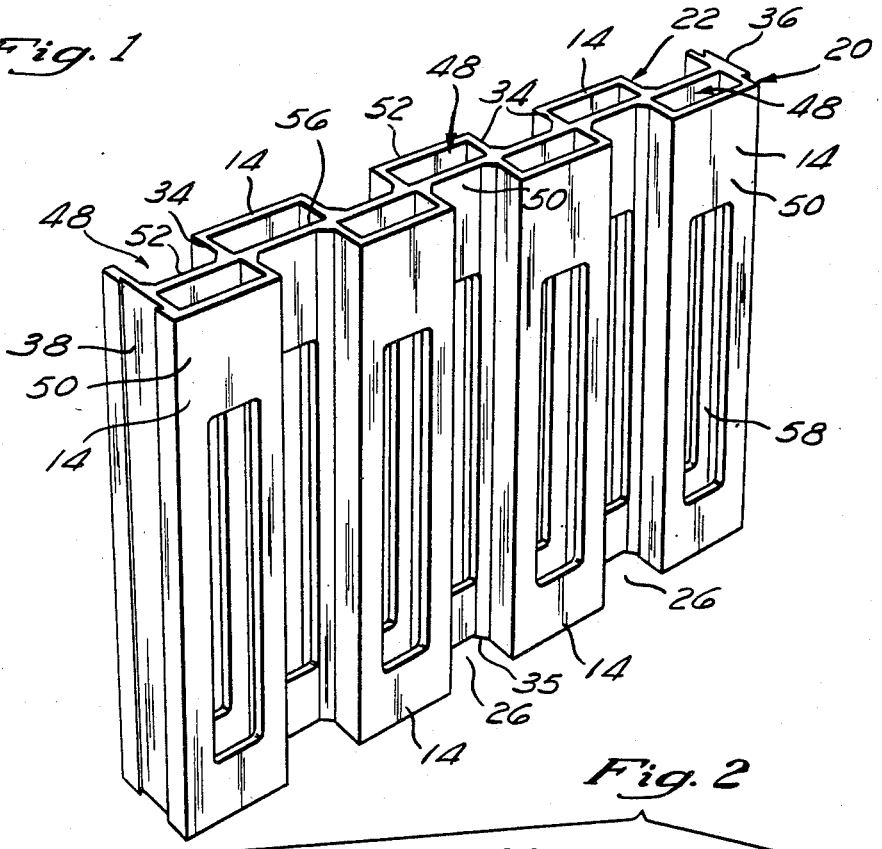
Fig. 2
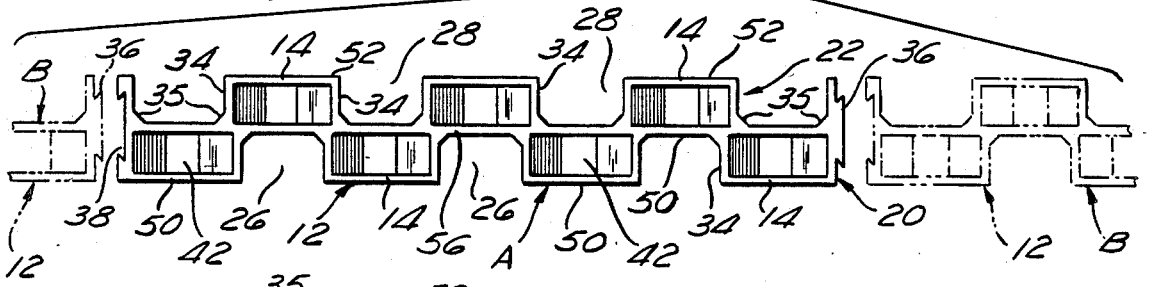
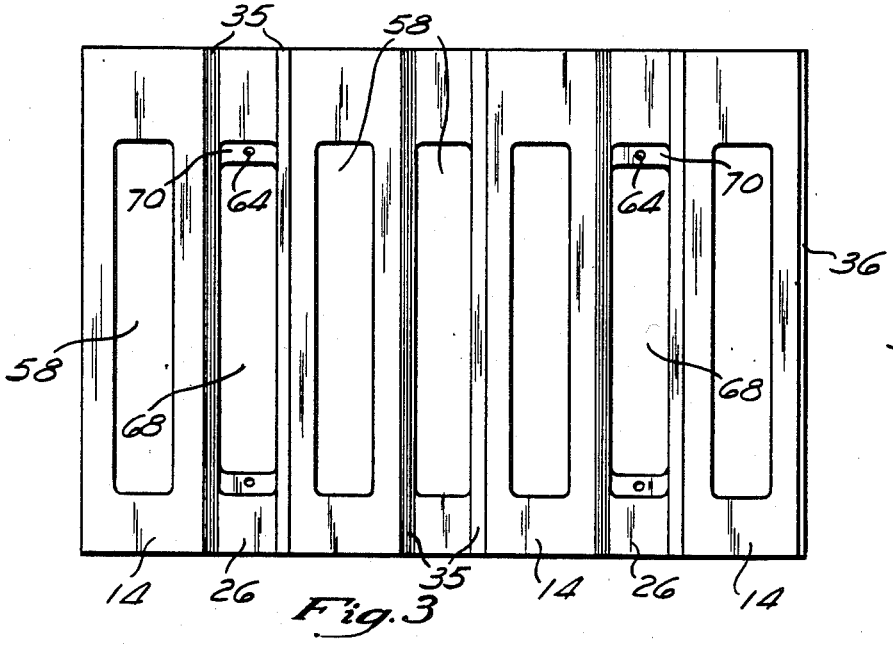
Fig. 3
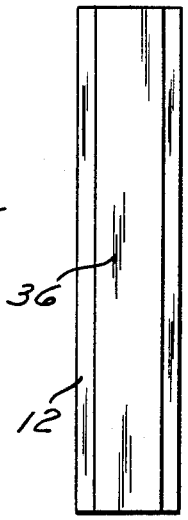
Fig. 4

Fig. 5
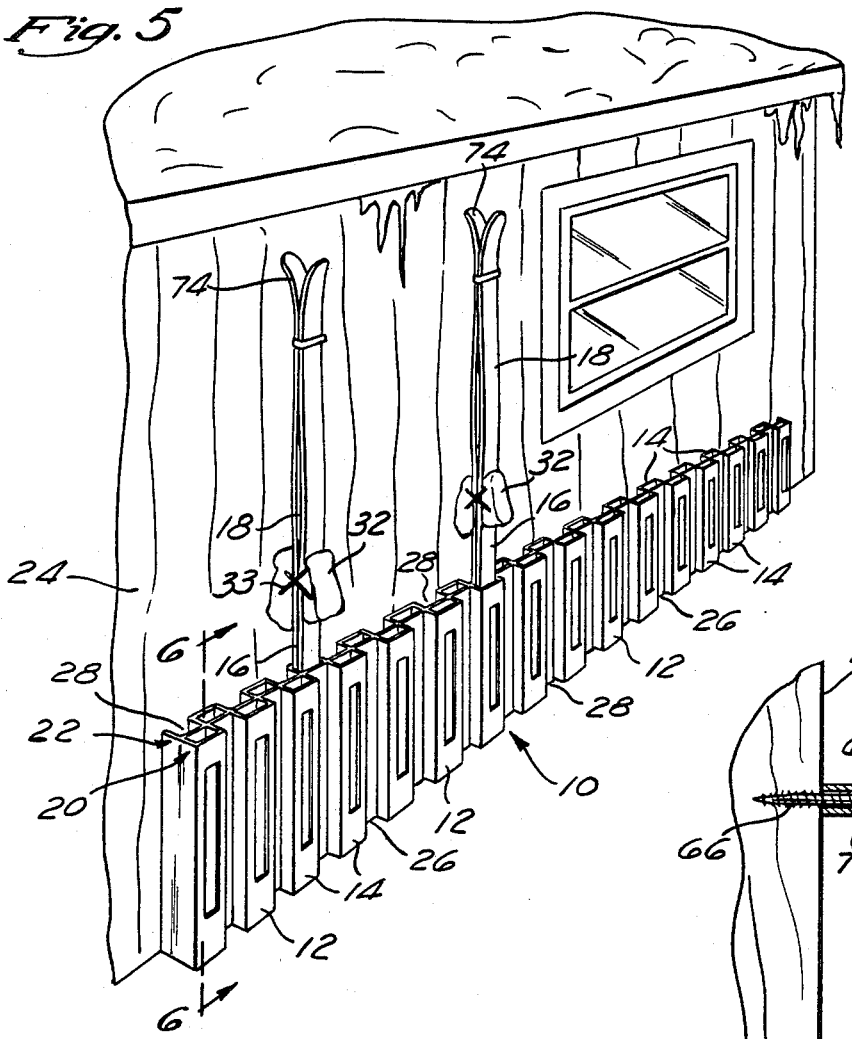
Fig. 6
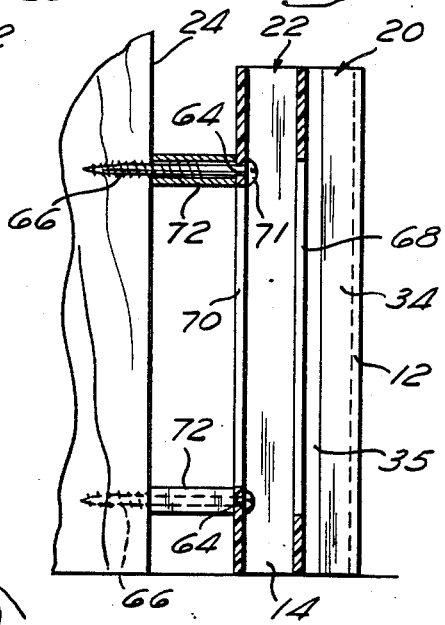
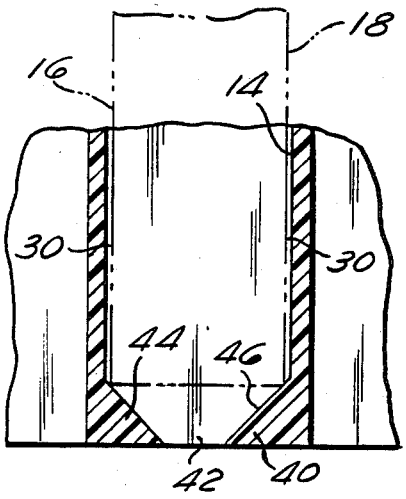
Fig. 7
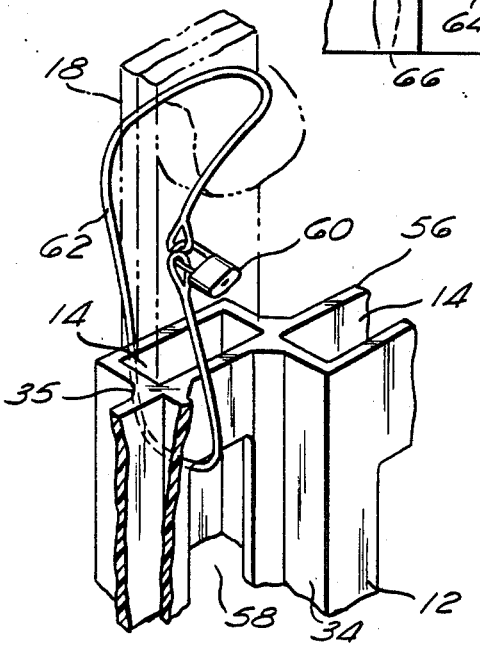
Fig. 8

Fig. 9
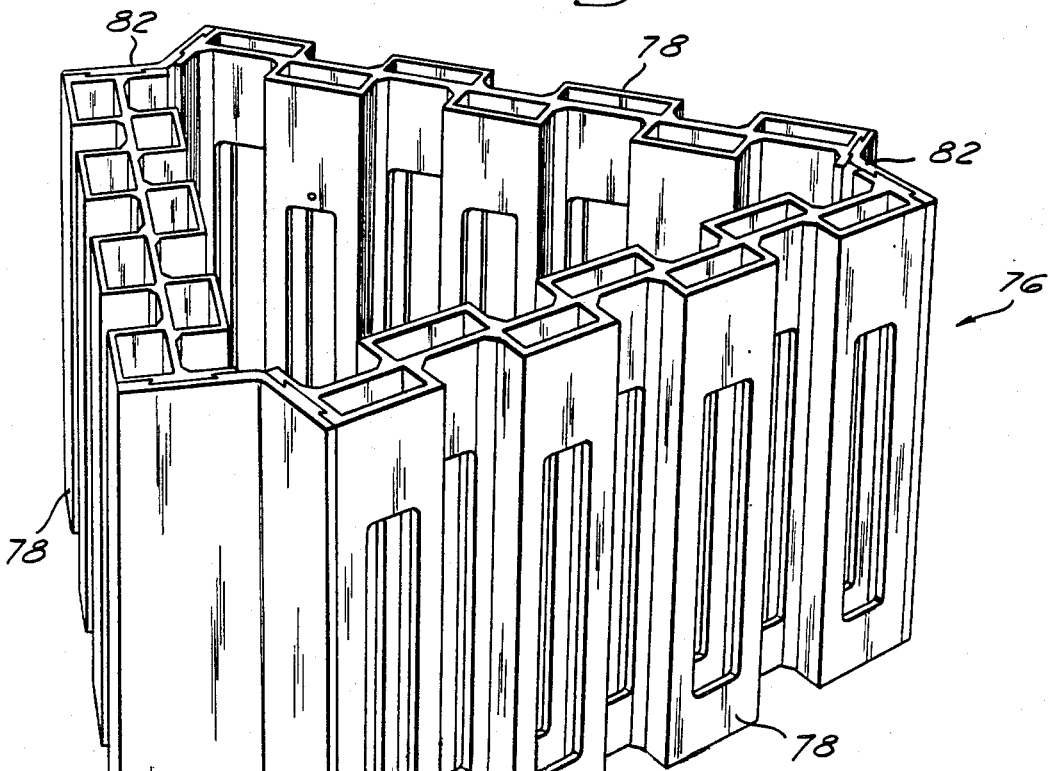
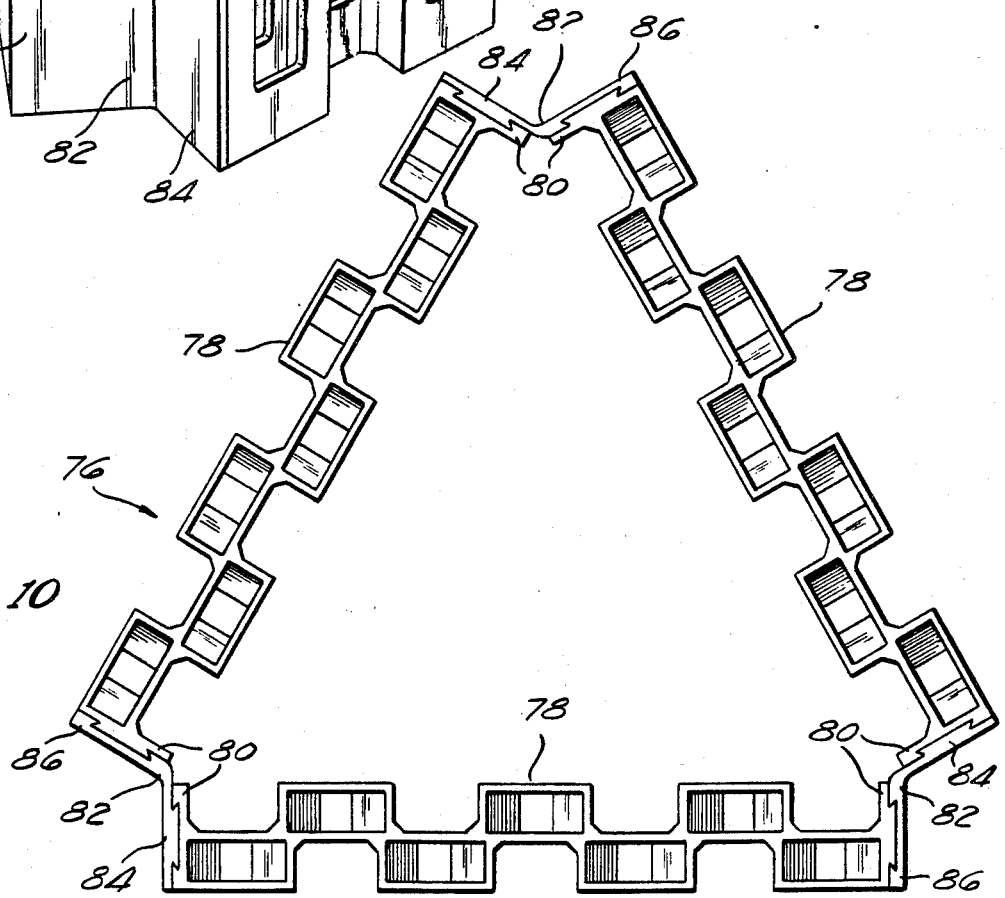
Fig. 10

MODULAR SKI RACK-

BACKGROUND OF THE INVENTION

This invention relates generally to a ski rack for storing skis in a densely packed, vertically upright position.

Racks which hold skis in a vertically upright position are used most frequently at ski resorts by guests who have gone indoors, and who wish to temporarily store their skis. Vertical storage is also utilized on the external walls of vehicles, such as buses, in which skiers are being transported. Racks are also useful in any other area where skis need to be stored temporarily or permamently.

There are several desirable features which should be incorporated into this type of ski rack. First, the rack should be able to store skis of all lengths. Ski lengths generally correspond to the height of the skier, and thus can vary to a large degree.

Secondly, the skis should be densely packed on the rack so that the rack does not occupy a large area. The racks usually are located near the door of the building through which the skiers are entering and exiting, and the more densely the skis are packed, the more skis that can be stored within close proximity of the door. Hundreds of skiers may simultaneously use a lodge or dining facility, and a densely packed ski rack is required to provide sufficient capacity to store all of these skis. Close packing is also vital when storing skis on the exterior of a vehicle, since the exposed vertical face of the vehicle is limited. Although skis should be closely packed, it is also important that there be sufficient space between each pair of skis to prevent entanglement with the adjacent skis on the rack.

If the skis cannot be stored on the rack, whether due to lack of space, proximity to the door, or ability to store that particular length of ski on the rack, many skiers will leave their skis strewn about the vicinity of the doorway, generally creating a traffic hazard. Often, skis are left leaning against a vertical surface, such as a wall, window, or tree. In addition to damaging these vertical surfaces, the skis can easily fall and in doing so, usually produce a domino effect on the adjacent skis.

Since the amount of wall space is generally limited, it is also advantageous to have a ski rack which can stand freely on the ground, without supports. Also, if the rack is free-standing, it can easily be moved to permit snow grooming or to permit flexibility in the location and capacity of storage facilities.

Ski racks consisting of a series of adjacent, elongated baskets or pockets in which the tail end of the skis can rest are known in the art. Often such an arrangement is found on the exterior wall of a gondola. The advantage of this type of rack is that it is suitable to hold skis of all lengths, and requires no moving parts to retain skis upright. However, previous racks of this type cannot alternatively be mounted on the ground as a free standing ski rack. Further, pairs of skis cannot be tightly packed in an edge to edge fashion due to the protruding brake rods on the bindings of many skis. To compensate for the width of the bindings, the pockets are often wider than the portion of the skis within the pocket, which wastes space and allows the skis to shift about.

Other ski racks utilize latches or hooks which restrain the upper portion of the skis, while the tail end of the skis rests on the ground or on a ledge. Examples of this type of ski rack include the patents to Gorlach (U.S. Pat. No. 4,062,453), Busch et al. (U.S. Pat. No. 3,722,652), and Novak (U.S. Pat. No. 3,826,378). Due to the fixed distance from the place where the tails of the skis are rested and the latch, these racks cannot support skis of all lengths. Also, the need to manipulate the latch is a major inconvenience to skiers who are usually wearing bulky gloves and whose fingers may be numb from the frigid climate often encountered at ski resorts.

Free-standing sawhorse type racks are shown in the patents to Bell (U.S. Pat. No. 3,685,667) and Bennett (U.S. Pat. No. 3,164,256). However, these racks are limited in application because they cannot be wall mounted and require access from both sides to efficiently utilize space.

Thus, a need exists for an improved ski rack which can be wall mounted or can stand freely, store skis of all lengths, and which allows the skis to be closely packed together.

SUMMARY OF THE INVENTION

Briefly stated, the invention consists of a ski rack comprised of modular units which can be interconnected to form a wall mounted linear rack of varying length, or with the use of angled adapters, connected to form various free standing zig-zag shapes or polygonal shapes.

The rack consists of two adjacent, parallel rows of spaced, vertically upright pockets in which the tail ends of the skis are supported. The rows are staggered so that where there is a space between pockets on one row there is a pocket on the other row. Since the sides of the pockets from one row to the other are aligned, the skis are effectively packed edge to edge, as if there were only one row of pockets with no spacing between them. However, due to the spacing of the pockets within a given row, the bindings of the skis do not interfere with each other, permitting a more densely packed arrangement of skis.

The pockets are preferably shaped like elongated rectangular boxes, each having a front, rear and two side walls, an open top through which the skis are introduced and removed, and a bottom wall which prevents the skis from protruding through the bottom of the pocket. The pockets are deep enough and narrow enough so that skis of all lengths will remain securely in place on the rack without additional restraining means. The bottom wall of each pocket is tapered toward a drain hole to direct melting snow out of the pocket, so snow and ice do not accumulate within the pocket.

The front and rear walls of the pockets include material saving cutouts or windows which prevent the accumulation of snow, and also permit the looping of a chain through the pockets to lock the skis to the rack.

Each modular unit has a dove-tailed male connector or tenon on one end and a mating female connector or mortise on the other end, so that the units can be strung together in an end to end fashion to form a linear rack which is suited for mounting on a vertical surface such as the exterior wall of a ski lodge or the side panel of a bus.

To form free standing polygonal or zig-zag shapes, adapters are used which connect the units at an angle. The adapters are brackets with two legs joined together at an angle to form a V-shape, with one leg of the adapter having a male connector, the other leg having a female connector.

Advantageously, the rack modules may be molded of polyurethane or other such plastic material which is durable and rugged and thus can handle the abuse of skis gouging it but yet is somewhat yieldable so as not to damage the skis.

BRIEF DESCRIPTION OF THE DRAWINGS

FIG. 1 is a perspective view of a single modular unit of the ski rack.

FIG. 2 is a top view of the modular unit of FIG. 1, with partial top views of the adjacent inteconnecting modules shown in dotted lines.

FIG. 3 is a front elevation of the modular unit shown in FIG. 1.

FIG. 4 is a side elevation of the modular unit shown in FIG. 1.

FIG. 5 is a perspective view of a series of modular units interconnected to form a linear ski rack which is mounted on a vertical wall surface.

FIG. 6 is a cross-sectional view of the rack in FIG. 5, taken along line 6—6.

FIG. 7 is a partial cross-sectional view of the bottom portion of one of the pockets forming the rack, with a pair of skis, shown in dotted lines, inserted within the pocket.

FIG. 8 is a cut-away perspective view showing a pair of skis which are locked to the rack.

FIG. 9 is a perspective view of three modular units interconnected by polygon adaptors to form a ski rack with a triangular configuration.

FIG. 10 is a top view of the rack shown in FIG. 9.

DETAILED DESCRIPTION OF THE PREFERRED EMBODIMENT

As shown in FIGS. 1, 2, and 5, in one preferred embodiment there is a ski rack 10 consisting of modular units 12 which can be interconnected to form a rack 10 which is substantially linear in shape, and which can be adjusted to a desired length.

Each modular unit 12 is comprised of a plurality of vertically elongated pockets 14, that is, with a vertical lengthwise axis so that the tail end 16 of a pair of skis 18 can be inserted into the pocket so that the skis are supported in a vertically upright position. (See FIG. 5)

The pockets on the rack are preferably rectangular in shape when viewed from above, as in FIG. 2. Alternatively, any other polygonal, curved or irregular shape may be utilized as long as the skis can be maintained in a vertically upright position by inserting the tail end of the skis into the pocket. The pockets must be deep enough and there must be a sufficiently small clearance between the skis and the walls of the pockets so that the skis will not tip over, fall out of the pockets or interfere with adjacent skis.

The pockets 14 are arranged in two rows, a front row 20 and a rear row 22, the rear row 22 being closest to the vertical surface 24 on which the rack is mounted. Each row is formed by a series of linearly aligned and spaced pockets. The rows are staggered or offset relative to one another so that the spaces 26 between the pockets of the front row 20 are adjacent, directly in front of, the pockets of the rear row 22, and, likewise, the spaces 28 between the pockets of the rear row 22 are adjacent, directly behind, the pockets of the front row.

This spaced and staggered configuration of the pockets enables the pockets to be closely packed, so that each pair of skis occupies a linear space along the rack which is no greater than the edge to edge width of the skis.

As shown in FIG. 7, the pockets are just wide enough to permit clearance between the walls of the pocket and the side edges 30 of the average sized pair of skis 18, shown in dotted lines. However, referring to FIG. 5, most skis have bindings 32 with brake rods 33 which protrude outwardly from the side edges 30 of the skis. If the pockets were aligned side-by-side, with no spacing between them, the protruding brake rods of the skis would interfere with the skis in the adjacent pockets. However, just widening the pockets or spacing the pockets apart to provide room for the bindings decreases the packing density of the skis, or the number of skis which can be stored on the rack for a given length of rack.

In the present invention, the adjacent pockets are spaced so there is sufficient room to the side of each pocket for the bindings; however, an increased linear packing density is achieved by staggering the second row of spaced pockets parallel to the first row. As shown in FIG. 2, the interior surface of the side walls 34 of the pockets in the front row are aligned with the interior surface of side walls of the pockets in the rear row. That is, there is no spacing between the inner sides of the pockets in one row and the inner sides of the pockets in the other row. This maximizes the packing density of the skis on the rack while still providing wide enough spaces 26 between the skis stored in the front row so that a pair of skis may be passed between the skis in the front row and to be inserted in or removed from the pockets of the rear row. To reinforce the joints between the corners of the pockets, gussets 35 are provided.

In terms of packing density, the pockets of the present rack are as closely packed as if there were a single row of pockets side-by-side, with no spacing between them. But, as a result of the spacing and staggering of the two rows of pockets, the skis can be easily inserted, stored, and removed from the rack without becoming entangled with the skis in the adjacent pocket of the other row. The configuration of the rack also allows sufficient room to manually grasp all of the skis, even when the rack is full.

As illustrated in FIG. 2, a series of modular units 12 can be interconnected by means of mating connectors on the ends of each modular unit. On one end of each unit, there is a male connector 36, and on the other end there is a mating female connector 38 which can be slidingly interengaged with the corresponding connector of the adjacent modular unit. Preferably, the male connector 36 is a dove-tailed tenon, and the female connector 38 is a dove-tail mortise which are vertically slidably engageable to form a dove-tail joint.

In order to continue the pattern of the staggered rows of spaced pockets from one interconnected modular unit to the next, there are two distinct configurations of the units; type A and type B, as indicated in FIG. 2. The two configurations are identical with regard to the arrangement of the rows of spaced pockets and the mating connectors on either end of the unit. The only difference between the two configurations is that type A has one more pocket on the front row than on the rear row, and type B has one more pocket on the rear row than on the front row. As a result, when the configurations are connected end-to-end in an alternating pattern (ABABAB), the spaced pockets and staggered rows of the rack will continue, uninterrupted, from one modular unit to the next, as shown in FIG. 5.

Referring again to FIG. 2, the type A unit has a space in the rear row on either end, adjacent the connectors. The type B unit has one more pocket in its rear row, so that adjacent the connector on either end there is a pocket in the rear row. Thus, the space in the type A unit is adjacent the pocket in the type B unit when the two are connected, so that the joints between the units do not cause an inconsistency in the pattern of the pockets and spaces.

Each pocket has an open top 48 through which the skis are introduced and removed, a partially closed bottom wall 40, a front wall 50, a rear wall 52, and two side walls 34.

The rear walls 52 of the front row pockets 20 and the front walls 50 of the rear row pockets 22 form a straight, flat, central wall 56 which runs along the entire length of each modular unit. The central wall 56 is essentially a common wall for all of the pockets, and encloses one side of each pocket.

As shown in FIG. 7, there is a bottom wall 40 in each of the pockets which prevents the skis from sliding through the pocket and protruding out the bottom. This is particularly to be avoided when the rack is mounted on a vertical surface with the rack raised above the ground, for example, when the rack is mounted on the exterior panel of a bus.

At the center of the bottom wall is a drain hole 42 which allows precipitation or any snow still remaining on the skis to drain out of the pocket, so as not to accumulate therein. To aid this drainage, the bottom wall is tapered at 44 and 46, to direct the drainage toward the hole 42.

The front and rear walls of each pocket have cut-out portions or windows 58. These windows reduce the quantity of material required to produce the rack, reduce the overall weight of the unit, and prevent snow, ice, and water from accumulating within the pockets.

As depicted in FIG. 8, the windows also enable skis to be locked to the rack by means of a lock 60 and a cable 62 which is looped through one or both of the windows, secured to the skis and locked together at its ends.

Referring to FIG. 3, several of the rear row pockets have bolt holes 64 adjacent the windows in their rear walls 52. Those rear wall windows are smaller in the vertical direction than the corresponding windows in the front wall of the same pockets, so that direct access to the bolt holes is provided through the front windows. As shown in FIG. 6, bolts or screws 66 pass through the bolt holes 64 and are used to mount the rack on a vertical surface 24. Since the window 68 in the front wall of the pocket is longer than the window 70 in the rear wall, a screwdriver or wrench can be easily manipulated to engage the head 71 of the bolt or screw 66.

Surrounding the shaft of each bolt 64 is a mounting adaptor 72 which consists of a tubular spacer that fits around the bolt and which separates the rack from the vertical surface 24. The rack must be spaced a short distance from the vertical surface to provide ample room for the skis stored in the rear row of the rack, since the tips 74 and bindings 32 of the skis will generallly protrude beyond the rear wall, as shown in FIG. 5. Preferably, the adaptor 72 is 4¼ inches long to provide adequate spacing.

Referring to FIGS. 9 and 10, a ski rack 76 is shown in a free-standing triangular shape, the legs of the triangle being formed by three modular units 78. Due to the enclosed triangular shape, the rack does not have to be fastened to a vertical or horizontal surface in order to stand upright on a horizontal surface and hold skis. Thus, the rack can be easily transported from one location to another, and is particularly suited for locations where there is little or no vertical wall space on which the racks can be mounted in a linear form, as in FIG. 5. The ease of transportation of the rack when in a polygon shape is particularly important in light of the fact that it is not uncommon to encounter snow storms which are severe enough to completely bury the ski rack overnight. Thus, the ski rack will frequently be moved to accommodate changing depths of snow, and the subsequent grooming of the snow.

The modular units 78 which make up the triangle can be of either type configuration, A or B. The ends of the units are not directly interconnected with the ends of the adjacent units, but are connected by means of polygon adaptors 82. The polygon adaptors are V-shaped brackets comprised of two straight legs 84 and 86 which are joined together at the apex of the V-shape to form an angle. One leg 84 has a male connector and the other leg 86 has a mating female connector which interconnects with the connectors 80 on the ends of the units so that the units are joined together at an angle.

Due to the ease with which the ski rack can be assembled into a polygon shape, or broken down into its component modules and adaptors, the rack can be transported with a minimum of effort and stored, once broken down, without occupying much space.

The adaptors can be formed with various angular orientations. The angle at which the legs of the adaptor are spread will determine the angle formed by the adjacent interconnected modular units, and therefore the shape of the polygon formed by the units. Also, the straight sides of the polygon can have varying lengths by connecting the modular units together in a linear fashion, as in FIG. 2, as well as at an angular orientation with the use of the polygon adaptors.

For example, the use of three adaptors with a 60° angle will result in an equilateral triangle, as shown in FIGS. 9 and 10. Four 90° adaptors will result in a square or rectangle, depending on the length of the sides. Irregular polygon shapes can be formed as well, by using adaptors of different angles, and sides of different lengths.

Although not shown, the units can be connected together by means of the angled adaptors to form various zig-zag shapes which are unenclosed, but which are sufficiently stable to be free-standing and selfsupporting.

In a preferred embodiment, the ski rack consists of modular units that are 23½ inches long, with a total of seven pockets, three in one row and four in the other. Each pocket is approximately 16 inches deep, and the inner wall surface of the pockets are 1¼ inches wide by 3¼ inches long. The front, rear and side walls of the pockets are approximately ¼ inch thick.

Preferably, the rack is formed from a polymer material such as a polyurethane. The advantages of polyurethane are that it is a durable, rugged material which can withstand the extreme cold temperatures often encountered at ski resorts. Also, snow does not stick to polyurethane even when cold. Another advantage of polyurethane is that it can be molded into the configuration of the rack with a minimum of labor intensive machining. Although it is rugged enough not to be gouged or otherwise damaged by skis, polyurethane will not damage or scratch the skis or bindings. Also, the material can be permanently pigmented in a variety of colors, and thus, never needs painting.

I claim:

1. A ski rack comprising a plurality of vertically elongated pockets in which the tail end of a pair of skis can be supported, said pockets having an open top through which the skis are introduced and removed, said pockets being aligned to form a substantially linear rack with a front row and rear row of pockets which are substantially parallel, the pockets forming the front row of the rack being spaced from each other and the pockets forming the rear row of the rack also being spaced, but staggered relative to the front pockets so that where there is a space between front pockets, there is a rear pocket, and vice versa, the width of the spaces between adjacent pockets in a row being less than the width of one of said adjacent pockets, enabling close, edge to edge packing of skis within a short linear space, without entanglement of the ski bindings.

2. The ski rack of claim 1, wherein said rack is comprised of modular units which can be joined in an end to end fashion to form an extended, linear rack.

3. A ski rack comprising a plurality of vertically elongated pockets in which the tail end of a pair of skis can be supported, said pockets having an open top through which the skis are introduced and removed, said pockets being aligned to form a substantially linear rack with a front row and rear row of pockets which are substantially parallel, the pockets forming the front row of the rack being spaced from each other and the pockets forming the rear row of the rack also being spaced, but staggered relative to the front pockets so that where there is a space between front pockets, there is a rear pocket, and vice versa, enabling close, edge to edge packing of skis within a short linear space, without entanglement of the ski bindings, said rack is comprised of modular units which can be joined in an end to end fashion to form an extended, linear rack, one end of each modular unit has a male connector, and the other end has a mating female connector, each end mating with the corresponding connector of the adjacent modular unit, said modular units being of two configurations, the first configuration having one more pocket on the front row than on the rear row, the second configuration having one more pocket on the rear row than on the front row, and said configurations are capable of being connected, end to end in alternating configurations for a desired length, while continuing the rows of staggered and spaced pockets from one modular unit to the next.

4. The rack of claim 2 wherein said modular units can be arranged to form various free-standing zig-zag and polygonal shapes of varying size by connecting the ends of the modular units together at an angular orientation.

5. The ski rack of claim 3, wherein said modular units are connected together at an angular orientation by V-shaped polygon adaptors to form various free-standing zig-zag and polygonal shapes, the angle at which the legs of the V-shaped adaptor are spread determining the angle at which the modular units are connected, one leg of the V having a male connector and the other leg of the V having a female connector, each adapted to mate with the connectors of the ends of the modular units.

6. A ski rack comprising a plurality of vertically elongated pockets in which the tail end of a pair of skis can be supported, said pockets having an open top through which the skis are introduced and removed, said pockets being aligned to form a substantially linear rack with a front row and rear row of pockets which are substantially parallel, the pockets forming the front row of the rack being spaced from each other and the pockets forming the rear row of the rack also being spaced, but staggered relative to the front pockets so that where there is a space between front pockets, there is a rear pocket, and vice versa, enabling close, edge to edge packing of skis within a short linear space, without entanglement of the ski bindings said pockets having a bottom wall which prevents the tail end of the skis from protruding through the bottom end of the pockets, said bottom wall having a drain hole therein to permit snow and water to drain out of the pocket.

7. The ski rack of claim 6, whrein said bottom wall is tapered toward said drain hole, to direct the flow of snow and water into the drain hole.

8. A ski rack comprising a plurality of vertically elongated pockets in which the tail end of a pair of skis can be supported, said pockets having an open top through which the skis are introduced and removed, said pockets being aligned to form a substantially linear rack with a front row and rear row of pockets which are substantially parallel, the pockets forming the front row of the rack being spaced from each other and the pockets forming the rear row of the rack also being spaced, but staggered relative to the front pockets so that where there is a space between front pockets, there is a rear pocket and vice versa, enabling close, edge to edge packing of skis within a short linear space, without entanglement of the ski bindings each pocket has a bottom, front and rear wall, and two sides, and said front and rear walls of the pockets have windows.

9. The ski rack of claim 8, wherein some of the pockets in the rear row have windows on their front walls which are larger than the windows on the rear wall, said larger front wall windows providing access to bolt holes in the rear wall which are adjacent the rear window, to facilitate fastening the rack to a vertical surface by means of bolts, screws or other fasteners.

10. The ski rack of claim 9, wherein said rack is mounted on a vertical surface by means of bolts or other fasteners which pass through said bolt holes and are secured to said vertical surface, said vertical surface being spaced from the rear wall of the rear row of the rack by means of tubular mounting adaptors between the rear wall and the vertical surface which surround the bolts or other fasteners, to provide room for the skis stored in the pockets of the rear row.

11. A ski rack comprising:

a flat, vertical central wall having a front and a rear side;

a plurality of spaced, vertical pockets on both the front and rear sides of said central wall, said central wall forming an enclosed side for the pockets, the pockets on the front of said central wall being staggered relative to the pockets on the rear of said central wall, so that where there is a space on the front of the wall, there is a pocket on the rear of the wall, and vice versa, said pockets being sufficiently elongated and open at the top to allow the tail end of a pair of skis to be inserted therein and rest upright without additional restraining means.

12. The ski rack of claim 11, wherein said rack is comprised of a plurality of modular units which have connector means on each end for connecting said modular units end to end to form linear rack which is mounted either on a vertical surface, or alternatively, connected end to end at an angle with an angled connector means at each joint, for forming a free-standing polygon or zig-zag of a desired shape and size.

13. The ski rack of claim 12, wherein said modular units are of two configurations, the first configuration having one more pocket on the front side of the central wall than on the rear side, the second configuration having one more pocket on the rear side than on the front side, and said configurations are capable of being connected end to end in alternating configurations to form a linear rack or linear segment for use as a polygon side of a desired length in which the staggering and spacing of pockets is not interrupted at the joints between modular units.

14. The ski rack of claim 11, wherein the walls forming the pocket, including the central wall, have windows.

15. The ski rack of claim 11, wherein said rack is fabricated from a durable, moldable polymer material which can withstand extreme cold temperatures and which, upon impact with skis, will not damage the skis or be damaged itself.

16. A modular ski rack comprised of a series of interconnecting modular units, each modular unit comprising:

a plurality of elongated pockets in which the tail end of a pair of skis rests to support said skis vertically upright, said pockets being arranged to form a substantially linear modular unit;

a dove-tailed male connector on one end of each modular unit and a mating dove-tailed female connector on the other end so that adjacent modular units can be slideably interconnected, end-to-end, to form an extended linear rack of a desired length; and a polygon adaptor which enables the mating ends of the modular units to be connected at angular orientations so that various free-standing polygon or zig-zag shapes can be formed by the modular units, wherein said adaptor consists of a bracket having two legs formed in a V-shape, one leg having a female dove-tail connector therein and the other leg having a male dove-tail connector therein to mate with the ends of the modular units.

17. A ski rack comprising a plurality of vertically elongated pockets in which the tail end of a pair of skis can be supported, said pockets having a bottom wall for supporting the skis and having an open top through which the skis are introduced and removed, said pockets being sufficiently tall and of such cross-section that the pairs of skis inserted therein will remain upright without additional restraining means, said pockets being aligned to form a substantially linear rack with a front row and rear row of pockets which are substantially parallel, the pockets forming the front row of the rack being spaced from each other and the pockets forming the rear row of the rack also being spaced, but staggered relative to the front pockets so that where there is a space between front pockets, there is a rear pocket, and vice versa, enabling close, edge to edge packing of skis within a short linear space, without entanglement of the ski bindings.

18. The ski rack of claims 1 or 17 wherein said pockets have a generally rectangular cross-section sized to receive the rear ends of a pair of skis with the flat bottom surfaces of the pair of skis in engagement with each other, the size of the pockets being only slightly larger than the cross-section of said engaged pair of skis, such that bindings on the mid-section of the skis will extend laterally beyond its pocket cross-section, and above the adjacent spaces in the row in which its pocket is located, and the curved tip of one ski of said pair extends laterally beyond its pocket cross section and above the adjacent space in the other row.

19. A ski rack comprising a plurality of vertically elongated pockets in which the tail end of a pair of skis can be supported, said pockets having an open top through which the skis are introduced and removed, said pockets being sufficiently tall and of such cross-section that the pairs of skis inserted therein will remain upright without additional restraining means, said pockets being aligned to form a substantially linear rack with a front row and rear row of pockets which are substantially parallel, the pockets forming the front row of the rack being spaced from each other and the pockets forming the rear row of the rack also being spaced, but staggered relative to the front pockets so that where there is a space between front pockets, there is a rear pocket, and vice versa, enabling close, edge to edge packing of skis within a short linear space, without entanglement of the ski bindings; said pockets having a generally rectangular cross-section sized to received the rear ends of a pair of skis with the flat bottom surfaces of the pair of skis in engagement with each other, the size of the pockets being only slightly larger than the cross-section of said engaged pair of skis, such that bindings on the mid-section of the skis will extend laterally beyond its pocket cross-section, and above the adjacent spaces in the row in which its pocket is located, and the curved tip of one ski of said pair extends laterally beyond its pocket cross-section and above the adjacent space in the other row.

* * * * *